US010648295B2

(12) United States Patent
Zaragoza Labes et al.

(10) Patent No.: US 10,648,295 B2
(45) Date of Patent: May 12, 2020

(54) EQUIPMENT FOR CONNECTION OF SUBSEA PIPELINES IN BLOCK ARCHITECTURE AND OIL DRILLING SYSTEM

(71) Applicant: FMC TECHNOLOGIES DO BRASIL LTDA, Rio de Janeiro (BR)

(72) Inventors: Alan Zaragoza Labes, Rio de Janeiro (BR); Huei Sun Lai, Rio de Janeiro (BR); Jorge Luiz Da Silva Bonfim, Rio de Janeiro (BR); Leonardo De Araujo Bernardo, Rio de Janeiro (BR); Rafael Renan Dos Santos Barreto, Rio de Janeiro (BR)

( * ) Notice: Subject to any disclaimer, the term of this patent is extended or adjusted under 35 U.S.C. 154(b) by 0 days.

(21) Appl. No.: 16/064,856

(22) PCT Filed: Dec. 21, 2016

(86) PCT No.: PCT/BR2016/050343

§ 371 (c)(1),
(2) Date: Jun. 21, 2018

(87) PCT Pub. No.: WO2017/106952

PCT Pub. Date: Jun. 29, 2017

(65) Prior Publication Data

US 2018/0371877 A1 Dec. 27, 2018

(30) Foreign Application Priority Data

Dec. 22, 2015 (BR) ..... 10 2015 032308 5
Apr. 29, 2016 (BR) ..... 13 2016 009664 1

(51) Int. Cl.
*E21B 43/017* (2006.01)
*E21B 17/02* (2006.01)
(Continued)

(52) U.S. Cl.
CPC ..... *E21B 43/017* (2013.01); *E21B 17/02* (2013.01); *E21B 34/00* (2013.01);
(Continued)

(58) Field of Classification Search
CPC ..... E21B 17/02; E21B 34/00; E21B 41/0007; E21B 43/0107; E21B 43/017; F16K 27/0263
See application file for complete search history.

(56) References Cited

U.S. PATENT DOCUMENTS 4,874,008 A * 10/1989 Lawson ..... E21B 34/04 137/315.09

FOREIGN PATENT DOCUMENTS

WO 2016/044910 A1 3/2016
WO WO-2016044910 A1 * 3/2016 ..... E21B 41/0007
WO 2017/000051 A1 1/2017

OTHER PUBLICATIONS

International Search Report issued in PCT/BR2016/050343 dated May 29, 2017 (2 pages).
(Continued)

*Primary Examiner* — James G Sayre
(74) *Attorney, Agent, or Firm* — Osha Liang LLP

(57) ABSTRACT

Equipment for connection of subsea pipelines for oil and gas fields includes one machined block manifold having at least one fluid import spindle of side input, one stop valves set provided on a surface of machined block manifold, which also receives a header and branches, a point for line support and device for subsea installation, subsea line or pipeline. This set is installed on a foundation frame in sea soil and will be part of an oil drilling system.

8 Claims, 5 Drawing Sheets

(51) Int. Cl.

| | |
|---|---|
| ***E21B 43/01*** | (2006.01) |
| ***E21B 41/00*** | (2006.01) |
| ***E21B 34/00*** | (2006.01) |
| ***E21B 43/013*** | (2006.01) |

(52) U.S. Cl.
CPC ..... *E21B 41/0007* (2013.01); *E21B 43/013* (2013.01); *E21B 43/0107* (2013.01)

(56) References Cited

OTHER PUBLICATIONS

Written Opinion of the International Searching Authority issued in PCT/BR2016/050343 dated May 29, 2017 (8 pages).

* cited by examiner

PRIOR ART

EQUIPMENT FOR CONNECTION OF SUBSEA PIPELINES IN BLOCK ARCHITECTURE AND OIL DRILLING SYSTEM

FIELD OF THE INVENTION

The present invention relates to equipment for connection of pipelines forming subsea lines of connection between two or more equipment, with an oil production platform in open sea, or directly to the offshore. Said pipelines are used for fluid of flow from production, or further destined to the injection or service on oil wells. The present invention is also related of a drilling system in an oil subsea oil field.

BACKGROUND OF THE INVENTION

Connection systems for subsea pipelines have major importance in the oil industry, especially at offshore area. Necessity to transport fluids in great depths connecting oil wells to the platforms, two or more subsea equipment or transport directly to the offshore, for example, requires kilometers of pipelines of fluid transport and, subsequently, of equipment connecting said pipelines.

The connection equipment (or termination) are assembled at intermediate points or at the end of pipelines and are typically composed of a metal frame for foundation on sea soil, control and fluid block valves, sections of intermediate pipelines and spindles for connection with other equipment, for fluid import and export, as well as injection or service on the well. In addition, a further frame is required, partially independent of foundation frame, which has the function of fix these components and to withstand the stresses generated by the weight of line during installation, keeping the components pressurized which have contact with the production or injection fluid out of load line during installation.

An example of typical subsea architecture diagram for connection between manifold for four wells and Pipeline End Termination (PLET) is shown on FIG. 1 (state of art). This diagram illustrates a production manifold which is used to collect fluids from the wells, exporting them to line connection equipment, such as a PLET by means of a jumper or spool.

A typical schematic view of a state of art manifold, spool or jumper, and PLET is the shown in FIG. 1. The manifold comprising fluid import/export spindles (1) is connect to the header (3) by means of block valve (2) to each Wet Christmas Tree (WCT) branch and an additional valve (4) for the header (3). This header (3) of the manifold, by a spindle, is connected to a jumper or spool (5)—rigid and flexible pipelines containing a vertical or horizontal crimp at each of its ends—by subsea connectors (6), which need to be locked or unlocked with the use of remotely operated subsea vehicles and still making the seal between equipment to avoid leaks. The jumper or spool (5), in turn, is connected to the PLET spindle, which has a block valve (7) to performing subsea line isolation (8) welded to the PLET. All these equipment have to be assembled on a frame (9) resistant enough to withstand all stresses from the lines, as indicated in FIG. 2. FIGS. 2 and 3 illustrate perspective and front cut views, respectively, the frame (9) of a typical PLET and detail of line supporting beam (10), as usually practice by the state of art.

The architecture illustrates in FIG. 1 then essentially needs a manifold, jumper or spool, PLET, six stop valves, which can varies as the manifold application or field need, and additionally more two connectors. It occurs that in operational practice, said state of arte architecture presents two potential points of undesirable fluid leak, which are the said connectors.

In addition, it is still necessary a plurality of other components, besides essentials, such as welding seams, secondary valves and components for seal that require a structural stress to withstand them. Other important factor is the particularity of subsea environment, whose increasing depth exert great pressure on the lines, making them increasingly heavy and demanding more of the equipment installed.

FIG. 4 shows a typical four wells system, where a manifold is interconnected to four Wet Christmas Trees (WCT), a jumper or spool connected to conventional PLET equipment. The production trees are linked to the manifold, the latter of which is intended to equalize the production from the wells. PLET is used to interconnect the manifold with the production lines. At the conventional frame of manifold and installation methods of conventional subsea equipment, it is not possible to realize a direct interconnection of line with said manifold. Thus, PLET it is necessary to perform the descent of production line, usually measuring kilometers and weighting on order of more than 600 tons, responsible for outflow of production and in order to be possible to make interconnection with manifold. In other words, at the traditional methods there is no possibility to make the direct connection of these production lines with manifold, thus needing PLET.

Furthermore, in traditional oil drilling systems, a plurality of other components, other than the above-mentioned essentials, such as weld beads, secondary valves, and seal components are required which require significant structural effort to support them. Another important factor is the particularity of the subsea environment, whose depth, increasing, exerts great pressure on the lines making them increasingly heavy and demanding more of the equipment installed.

As is known, subsea equipment typically have a very robust structure, ie, high dimensions and weight to withstand underwater conditions, where pressure and corrosion resistance requirements are severe, as well as extreme loads occurring during Installation of the same. When manufacturing a PLET or PLEM (Pipeline End Manifold) type of equipment, it is first necessary to develop the project design and then proceed with the manufacture of pressurized elements such as valves, pipes and ducts. Once these elements are manufactured, they must be integrated with the metallic interface structure with sea soil, such as foundation, balconies or mudmat, as well as with the supporting metal beams for these components necessary for the installation of the equipment in the soil subsea. The integration of these components requires critical weld strands, that is, complex processes since welding requires both special preparation and qualification, which are costly and time consuming processes. Currently, the integration process requires at least four months for the manufacturing and delivery process of PLET-type equipment.

PLET-type equipment is then connected to a flexible or rigid pipe through which the oil/gas production flows or the water/gas is injected into the WCTs installed in the wells. This tube in an subsea field extends for kilometers of distances, for example, 10 km, representing a typical weight of about 600 tons. When installing PLET-type equipment, this pipe will be connected to the equipment, as shown in FIG. 3. However, it is required that the load line from the loads carried by that tube does not pass through the pressurized elements, such as valves, pipes and ducts and, in order to comply with this requirement, a structural support beam (10) of the line to support this weight, thereby protecting said pressurized elements which are in contact with the production or injection fluid. Said structural framework is shown in FIGS. 2 and 3.

The support structure, including said supporting beam of the line (10), adds to the equipment a very high dimension and weight requiring special vessels for its installation. As the PLET design is not standardized and has support structures that change as needed, special vessels and support logistics for the installation are changed on a case-by-case basis, making the subsea field projects more expensive and increasing the actual time of its installation.

All of these factors contribute significantly to delaying the subsea production process, increasing costs related to design, fabrication, testing, transportation, mechanical integration, and installation of equipment in the seabed.

Currently there are in the market efforts and technological developments in an attempt to reduce the costs of the equipment for production and oil drilling. In this sense, an effort has been made in researches and solutions carried out in the equipment itself as well as solutions that make feasible the optimization of the configuration of the subsea field, but to date there is no adequate solution for this technological demand.

The present invention advantageously, robustly and efficiently solves all of the above-mentioned drawbacks of the prior art, in addition to others arising and not mentioned herein.

BRIEF DESCRIPTION OF THE INVENTION

Thus, the objective of the present invention is to provide a new equipment for connection of pipelines directed to subsea applications that also represents an optimization of the oil drilling field system.

As will be appreciated, the equipment for connection of pipelines of the present application has a simplified configuration allowing the connection of the duct directly to the valve block and no longer requiring special structural framing to protect the pressurized elements which are in contact with the production fluid or injection. Its lifting, as well as the load line during installation/operation, will take place through fixed or articulated eyebolts integral to the valve block.

The apparatus for connection of subsea pipelines in block architecture according to the present invention basically comprises one or more fluid import/export spindle, one or more stop valves and an undersea line, mounted on a machined block manifold structure containing the header, as well as branches. The equipment according to the present invention also has point for line support and device for subsea installation.

Since the block architecture described herein is capable of withstanding loading and installation/operating pressures, the need for a metal structure to support and sustain the load (or stresses) suffered by the equipment exerted by the pipe will, therefore, eliminated, leaving the equipment lighter, more robust and more effective.

In addition, the block architecture allows the coexistence of two equipment in only one, in other words, PLET has absorbed the possibility of interconnecting the wells and receiving the necessary stop valves. Still, the new equipment becomes feasible because block manufacture, in addition to greatly reducing the size of the manifold, does not require the metallic support structure for the installation loads and for the pressurized elements.

Preferably, the block manifold used in the equipment of the present invention has structure and operation according to that object of the international patent application PCT/BR2015/050158 (which corresponds to US Patent Publication No. 2017/0241243), hereby fully incorporated by reference

BRIEF DESCRIPTION OF DRAWINGS

The equipment for connection of subsea pipelines in block architecture according to the present invention may be well understood with the description of the other attached schematic figures, which in a non-limiting or restrictive way of the structure developed, illustrate.

DETAILED DESCRIPTION OF THE INVENTION

Figure 5:
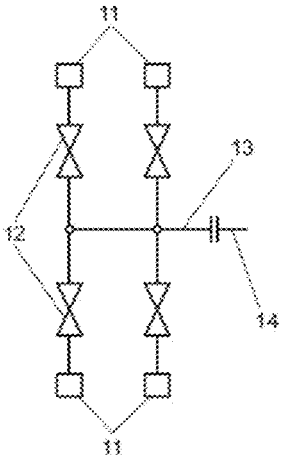
PRIOR ART FIG.5
FIG. 5—schematic diagram of architecture for connection of lines or subsea pipelines according to present invention.

Essentially, in FIG. 5 is illustrated the simplified schematic architecture diagram of the equipment for connection of subsea pipelines in block architecture according to the present invention, for use in four wells. It will be noted, then, that the equipment has been significantly simplified to only include connection between fluid import spindle (11) and subsea line or duct (14), assembled in the manifold block (13) which is provided with stop valves (12). As can further be seen, the flow of the fluid to be transported will occur in the sense (11)-(12)-(13)-(14),—the reverse flow being used in applications for injection or service systems. It is noteworthy that the stop valves (12) are located inside the block (13) and thus protected.

Figure 2:
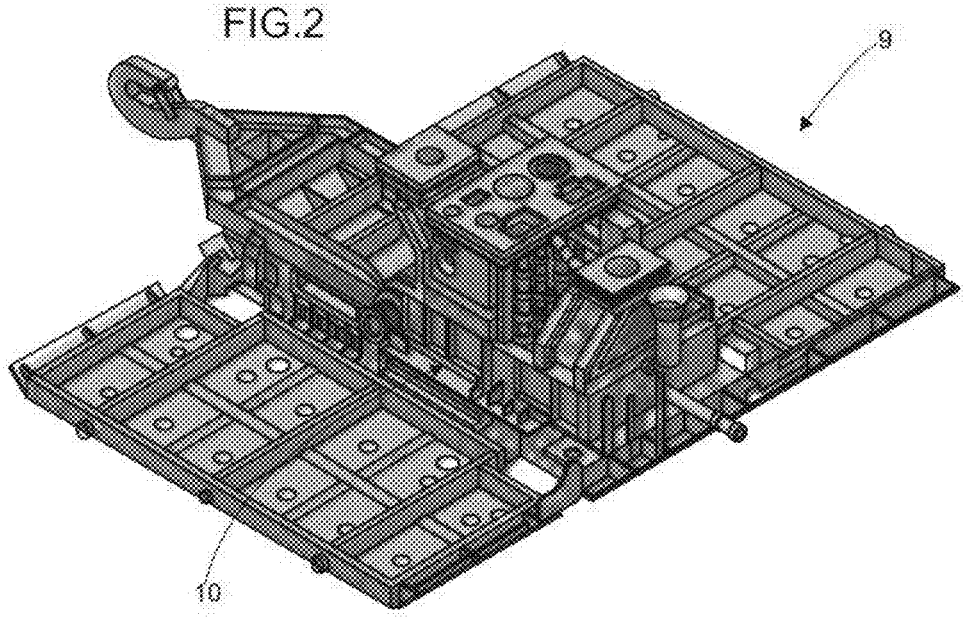
PRIOR ART FIG.2
FIG. 2—a perspective view of a typical pipeline end termination known in the art.
Figure 3:
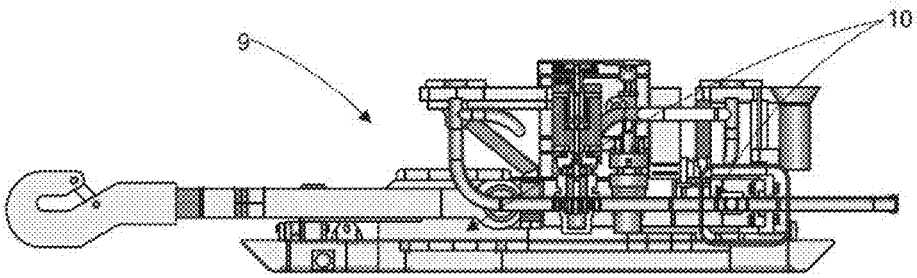
FIG. 3—a front cut view of the typical pipeline end termination of FIG. 2.
Figure 4:
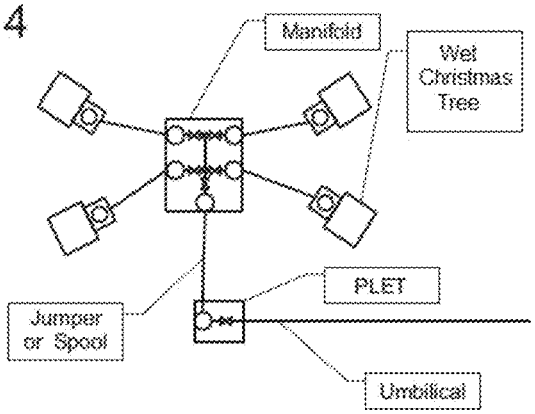
PRIOR ART FIG.4
FIG. 4—a schematic diagram of a typical four wells system with a manifold interconnected to four wet Christmas trees, a jumper or spool connected to conventional pipeline end termination equipment.

With such equipment configuration according to the present invention, the subsea line or pipeline will be attached directly to the valve block and no longer to the line support structure as occurs in a typical prior art design shown in FIGS. 2 and 3.

Figure 6:
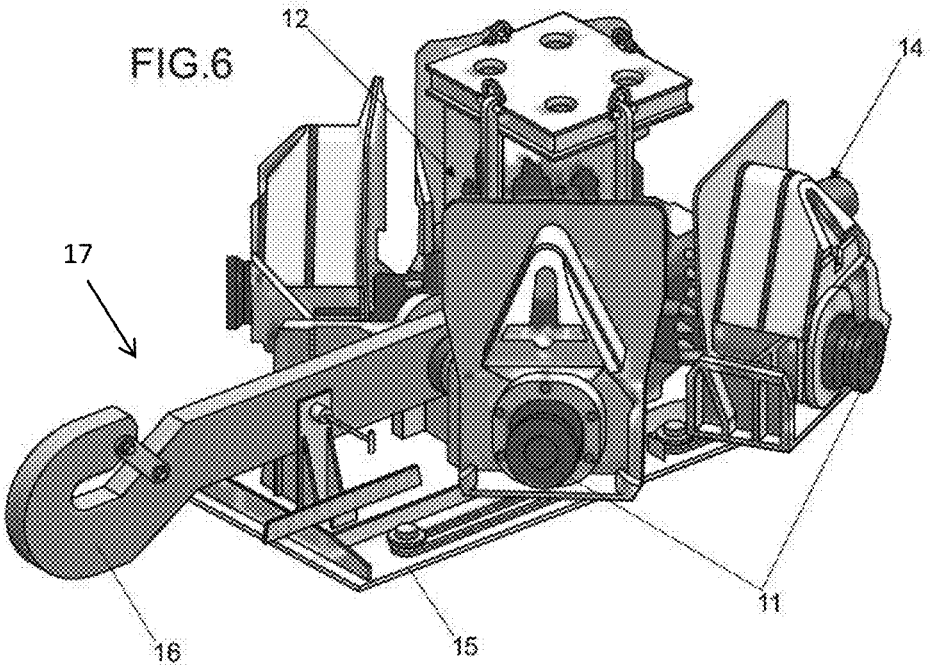
FIG. 6—perspective view of the equipment for connection of lines or subsea pipelines object of the present invention.
Figure 7:
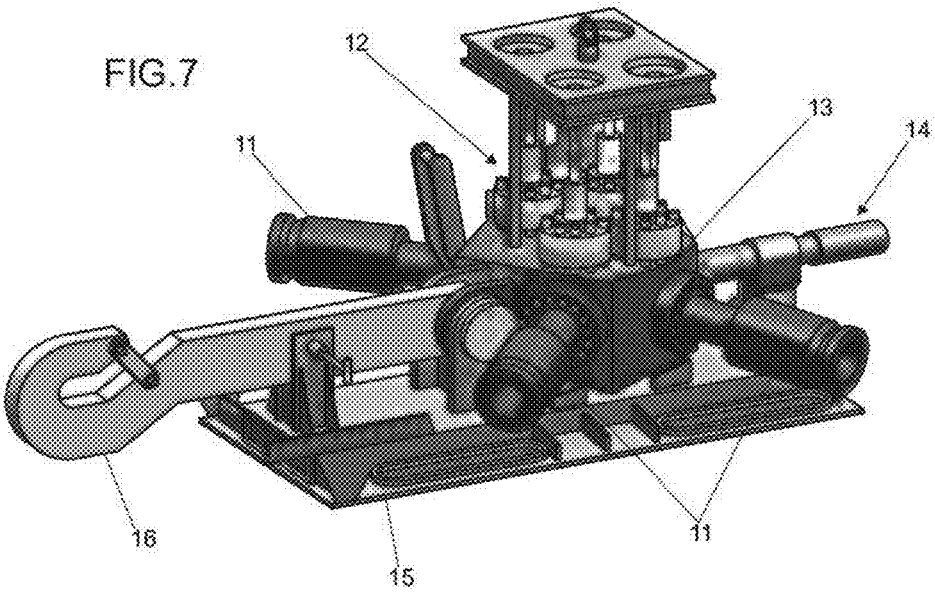
FIG. 7 is a perspective view of the equipment for connection of lines or subsea pipelines shown in FIG. 6, showing the manifold in block.

In FIGS. 6 and 7, it is observed that the equipment for connection of subsea pipelines in block architecture according to the present invention comprises a machined block manifold (13) provided with at least one side input import/export fluid spindle (11), a stop valves set (12) provided on the surface of said machined block manifold (13), which also receives the main and header pipes and machined branches, line support point and device for subsea installation (17) and the subsea line or pipeline (14). This whole set is able to be installed on a foundation frame in sea soil (15).

Figure 8:
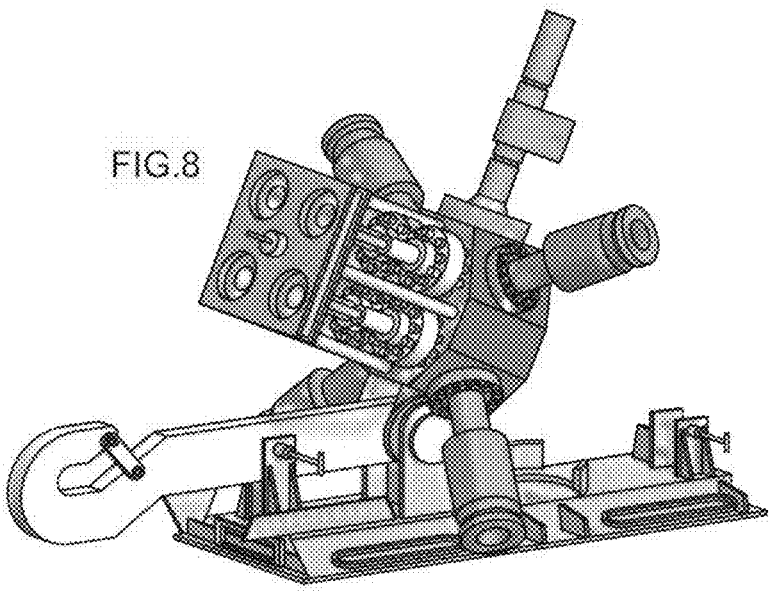
FIG. 8—perspective view of the equipment for connection of lines or subsea pipelines object of the present invention in installation of the first end where it is suspended by the subsea line or pipeline.
Figure 9:
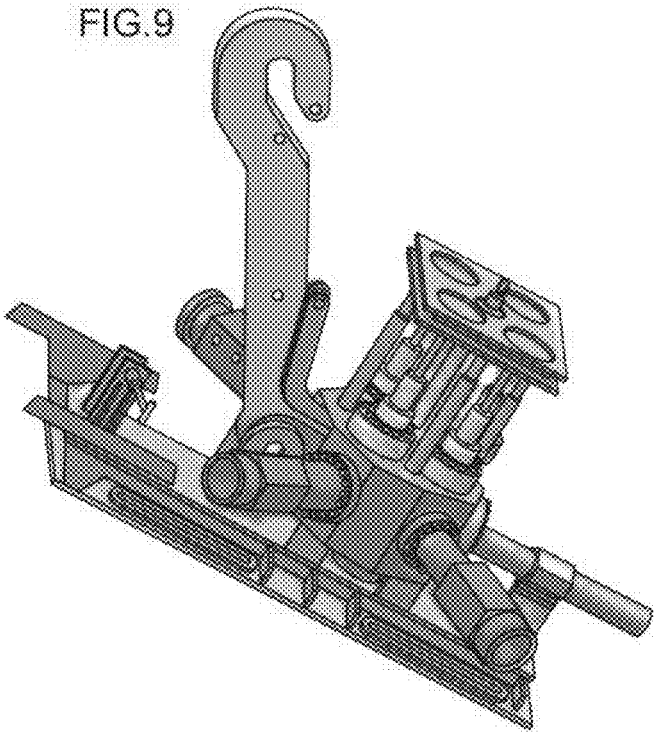
FIG. 9—perspective view of the equipment for connection of lines or subsea pipelines object of the present invention in installation of the second end where the equipment is suspended by the eyebolt.

Referring to FIG. 8, it is observed that the equipment is provided with an eyebolt (16), fixed or pivotally integral with that of the machined block manifold (13). Said eyebolt (16) is used for equipment lifting and therefore reduces structural function only to the foundation in sea soil. A direct consequence of this new equipment configuration of present invention is the withdrawal of any metallic support structure through a framework to support the tube/umbilical tension, consequently reducing the weight of the equipment. Still referring to FIG. 8, is illustrated the lifting position of the first end of the line with the second end is suspended or not yet completed, while in FIG. 9 the position of installing the second end of the line is illustrated, with the first end already resting on the ground. Thus, the structuring of the equipment according to the present invention will take the weight of the umbilical to be supported by the machined block (13) itself.

The internal cleaning operation of the lines or subsea pipelines will also be possible with this new concept, using curve bore machining that meets the minimum radius of the pigs normally used for this, as well as pig leading bars at intersections between the holes.

Figure 1:
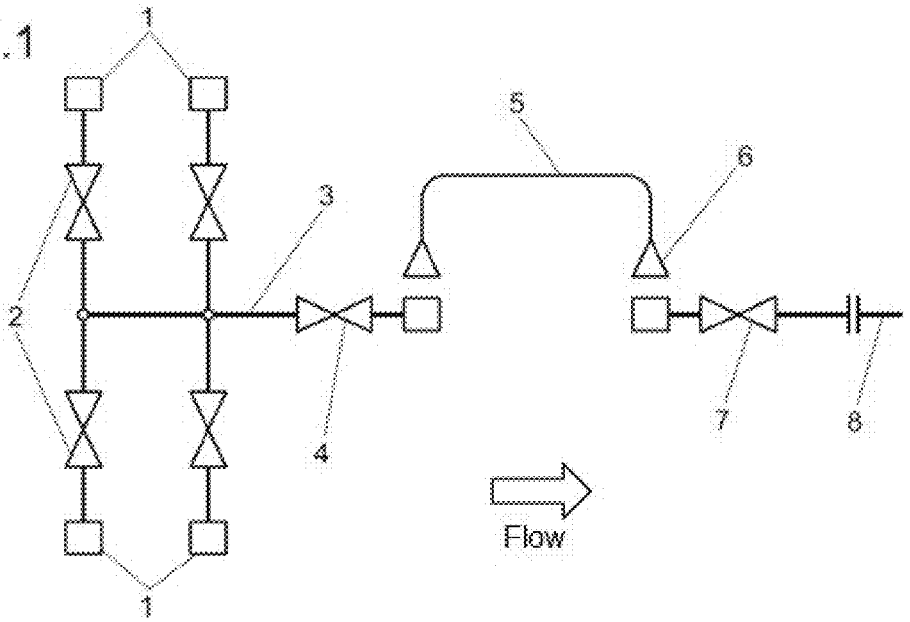
FIG. 1—schematic diagram of a state of the art manifold, spool or jumper, and pipeline end termination.

In relation to the scenario described as prior art and represented in FIGS. 1, 2 and 3, the equipment for connection of subsea pipelines object of the present invention comprises significant advantages related, not limitatively, to the reduction of the quantity of subsea equipment, or even the elimination of some of these. In this way, jumper or spool (5), as well as its subsea connectors (6), can be removed from the equipment, thereby increasing system reliability and decreasing undesirable points of leakage. As a result, the spindle and isolation valves (4) and (7) of the header (3) can also be removed, since their main functionality is no longer essential.

Further, the equipment for connection of subsea pipelines object of the present invention comprises further advantages over prior art equipment such as, for example:

- valve block supporting greater stress during line installation, reducing the function of the structure only to the foundation.
- there is no welded component exposed to high line stresses, increasing system reliability.
- reduction of the number of parts of the equipment, such as valves, connectors, spindles, pipes, sealing elements.
- significant reduction of equipment weight, making transportation, production and installation easy.
- reduction of manufacturing time, assembly, test, mechanical integration and subsea installation.
- serves a larger number of oil wells simultaneously.

Considering all the above-mentioned effects and advantages it would be conclusive that the equipment for connection of subsea pipelines equipment according to the present invention converges to a final design with fewer components, in addition to requiring less welded components. It is known to those skilled in the art that welding processes, especially those for applications where high work loads are required, are generally expensive to execute, requiring even heat treatments for stress relief.

Table 1 below illustrates objectively the comparison of the approximate weights for a typical prior art system and for the corresponding equipment for connection of subsea pipelines equipment according to the present invention.

TABLE 1

| Weight of structural components | | | | |
|---|---|---|---|---|
| | Equipment | Typical System (4 Wells) | Invention (4 Wells) | Invention (6 Wells) |
| Weight (t) | Manifold | 30 | N/A | N/A |
| | Jumper or Spool | 8 | N/A | N/A |
| | PLET | 25 | 30 | 38 |
| | Total Systema | 63 | 30 | 38 |

The present invention also relates to an oil drilling system, for example, for field application containing four wells, comprising an equipment composed of a forged block with internal valves, horizontal connectors connected to the production shafts, a header to drain the production through the production line of the platform (or coming from other subsea equipment, e. g., manifold or PLET) and a tool that allows the interconnection of this equipment with other PLETs or other subsea equipment for a future expansion of the field of production to more than four wells.

Figure 10:
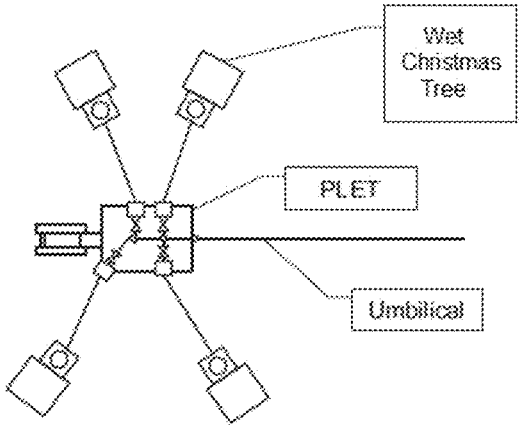
FIG. 10—Schematic diagram of the oil drilling system according to the invention for four wells.

A typical oil drilling system for field application containing four wells is shown in FIG. 10. In this it will be seen that said four well system comprises at least one machined block manifold (13) provided with at least one side input fluid import spindle (11), at least one stop valves set (12) provided on the surface of said machined block manifold (13), which also receives the main pipe or header and machined branches, said system further comprising at least one line support point and device for subsea installation (17), as well as an subsea line or pipeline (14).

As can thus be appreciated, the equipment object of the present invention has great versatility to be used in oil drilling fields, providing, in addition to the important technical advantages mentioned above, the possibility of being installed as a basic unit, and then having necessity to increase the extension of the oil drilling field, to be modulated to meet a larger number of wells, without requiring a significant increase in manufacturing time, assembly, tests, mechanical integration and installation in the subsea bed. This facility will be evident to those skilled at the art and admittedly a great advantage for oil drilling companies.

The invention claimed is:

1. An apparatus for connection of subsea pipelines in block architecture, comprising:

a machined block manifold having:

a manifold block;

at least one fluid import spindle of side input coupled to the manifold block;

at least one stop valves set located inside and coupled to a surface of the manifold block;

a header and branches machined in the manifold block; and at least a point for line support and a device for subsea installation of the apparatus and a subsea line or pipeline coupled directly to the manifold block.

2. The apparatus, according to claim 1, wherein the apparatus is installed on a foundation frame to be installed on sea soil.

3. The apparatus, according to claim 1, wherein said device for subsea installation is an eyebolt fully fixed or articulated to the machined block manifold.

4. The apparatus, according to claim 3, wherein said eyebolt is configured for lifting the apparatus for installation.

5. The apparatus, according to claim 1, wherein the subsea line or pipeline is directly fixed on the manifold block of machined block manifold.

6. The apparatus, according to claim 1, wherein there is no jumper or spool connection.

7. The apparatus, according to claim 1, wherein the apparatus is used in oil wells in the seabed and has the function of extracting or injecting fluids and other services.

8. An oil drilling system, having four drilling wells, the oil drilling system comprising:

at least one machined block manifold having:

a manifold block;

at least one fluid import spindle of side input coupled to the manifold block;

at least one stop valves set located inside and coupled to a surface of manifold block;

a header and branches machined in the manifold block; and at least one point for line support and a device for subsea installation of the apparatus and a subsea line or pipeline coupled directly to the manifold block.

* * * * *